US006584817B1

(12) United States Patent
Lien

(10) Patent No.: US 6,584,817 B1
(45) Date of Patent: Jul. 1, 2003

(54) ELECTRONIC ANTI-THEFT LOCK

(75) Inventor: Chih Min Lien, Taichung (TW)

(73) Assignee: WFE Technology Corp., Taichung (TW)

( * ) Notice: Subject to any disclaimer, the term of this patent is extended or adjusted under 35 U.S.C. 154(b) by 0 days.

(21) Appl. No.: 10/217,539

(22) Filed: Aug. 14, 2002

(51) Int. Cl.[7] ..... E05B 47/06

(52) U.S. Cl. ..... 70/277; 70/278.7; 70/283; 292/144; 292/150

(58) Field of Search ..... 70/134, 277, 283, 70/279.1, 278.7, 278.2, 278.3, 278.6, 283.1; 292/144, 150

(56) References Cited

U.S. PATENT DOCUMENTS

| | | | | | |
|---|---|---|---|---|---|
| 657,211 | A | * | 9/1900 | Carleton | |
| 722,258 | A | * | 3/1903 | Sines | |
| 1,011,956 | A | * | 12/1911 | Hild | |
| 1,124,666 | A | * | 1/1915 | Schutzmann | |
| 2,082,806 | A | * | 6/1937 | Michel | |
| 3,396,560 | A | * | 8/1968 | Casalis | |
| 3,733,861 | A | * | 5/1973 | Lester | 70/153 |
| 4,784,415 | A | * | 11/1988 | Malaval | 292/144 |
| 4,866,961 | A | * | 9/1989 | Yang | 70/129 |
| 4,902,053 | A | * | 2/1990 | Hakkarainen et al. | 292/144 |
| 5,029,912 | A | * | 7/1991 | Gotanda | 292/143 |
| 5,100,184 | A | * | 3/1992 | Schmitt | 292/144 |
| 5,839,306 | A | * | 11/1998 | Nunuparov | 70/283 |

FOREIGN PATENT DOCUMENTS

| | | | | |
|---|---|---|---|---|
| AT | 10446 | * | 1/1903 | 292/144 |
| GB | 1137760 | * | 12/1968 | 292/150 |
| IT | 308285 | * | 5/1933 | 70/283 |
| IT | 407164 | * | 11/1946 | 70/278.3 |

* cited by examiner

*Primary Examiner*—Lloyd A. Gall
(74) *Attorney, Agent, or Firm*—Rabin & Berdo, P.C.

(57) ABSTRACT

An electronic anti-theft lock mainly internally includes an electromagnetic valve having a vertically movable rod; a locating mechanism that includes a turning plate adapted to shift the whole mechanism inward or outward in multiple steps, a restoring plate adapted to mechanically depress the rod of the electromagnetic valve at an upward extended position, and a stopper adapted to engage with the extended rod of the electromagnetic valve to stop the locating mechanism from moving inward further; and a control circuit adapted to detect a correct IC code of an inserted chip-contained key, and to excite the electromagnetic valve to extend the rod to stop a locking bolt of the locating mechanism from moving inward to open the lock only when an incorrect IC code is detected.

2 Claims, 5 Drawing Sheets

ELECTRONIC ANTI-THEFT LOCK

BACKGROUND OF THE INVENTION

The present invention relates to an electronic lock, and more particularly to an electronic anti-theft lock having an electromagnetic valve that is excited to extend a rod to stop a locking bolt from moving inward to open the lock only when a key with incorrect IC code is detected by an internal control circuit of the lock, and the extended rod can be mechanically depressed again by a restoring plate, making the lock simple, reliable, and practical for use.

People use locks and keys to protect their life and properties against infringements by others. A conventional lock is usually mechanically opened with a key. For an experienced thief, such conventional mechanical lock can be opened within only one or two minutes. Therefore, the conventional lock actually forms a potential threat to people's life and properties. There are various types of electronic locks developed and available in the market, such as IC cards, magnetic cards, combination locks, wireless remote-control locks, and the like. Most of these electronic locks include a locking mechanism having an internal electric-powered mechanism, such as an electromagnet or an electric motor, which enters into and keeps in an unlockable state once the lock is closed. To open an electronic lock, a key corresponding to the electronic lock must be inserted. When an internal microcomputer of the electronic lock detects from the inserted key a correct IC code, it sends out a command to release the electric-powered mechanism from the unlockable state and energizes the same to open the lock.

It is unquestionable the electronic lock controlled with an IC code provides very good anti-theft function. However, there are still some problems with the actual use of such electronic lock. A major one of these problems is the locking mechanism of the conventional electronic lock enters into and keeps in the unlockable state for a prolonged time once the lock is closed. In the event any of the circuits, batteries or electric-powered mechanism inside the lock is disordered, an embarrassing condition of an unlockable electronic lock would occur. A common practice to overcome this problem is to add a preparatory lock to the electronic lock. When a part of the circuits of the electronic lock becomes failed, for example, due to exhausted batteries or problems with the electronic circuits thereof, a user may use a key to mechanically open the electronic lock via the preparatory lock. A problem with the preparatory lock is it can be unlocked with general lock-opening tools even if the electronic lock is in good condition. Thus, the preparatory lock forms another potential threat to the user and largely reduces the anti-theft function of the electronic lock. This is why the conventional electronic locks are applied to only limited places.

It is therefore tried by the inventor to develop an electronic anti-theft lock that enters into an unlockable state only when a chip-contained key having an incorrect IC code is detected, and the unlockable state can be released via a mechanically movable restoring plate inside the lock, making the lock simple, reliable, and practical for use.

SUMMARY OF THE INVENTION

A primary object of the present invention is to provide an electronic anti-theft lock that enters into an unlockable state only when a chip-contained key having an incorrect IC code is detected, and the unlockable state can be released via a mechanically movable restoring plate inside the lock.

To achieve the above and other objects, the electronic anti-theft lock of the present invention mainly internally includes an electromagnetic valve having a vertically movable rod; a locating mechanism that includes a turning plate adapted to shift the whole mechanism inward or outward in multiple steps, a restoring plate adapted to mechanically depress the rod of the electromagnetic valve at an upward extended position, and a stopper adapted to contact with the extended rod of the electromagnetic valve to stop the locating mechanism from moving inward further; and a control circuit adapted to detect a correct IC code of an inserted chip-contained key, and to excite the electromagnetic valve to extend the rod to stop a locking bolt of the locating mechanism from moving inward to open the lock only when an incorrect IC code is detected. And the unlockable state can be released by depressing the extended rod of the electromagnetic valve with the mechanically movable restoring plate, making the lock simple, reliable, and practical for use.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
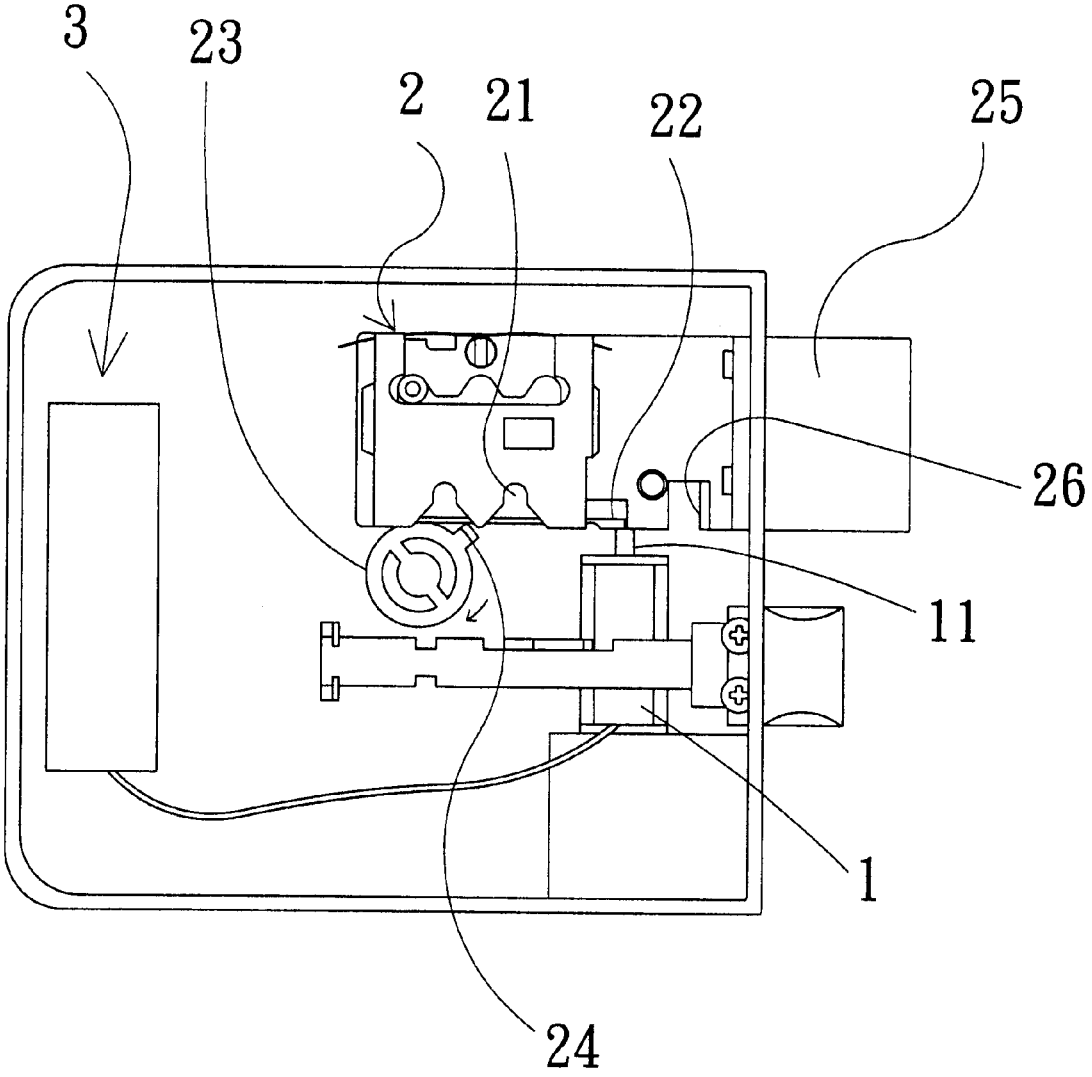
FIG. 1 is a plan view showing an internal structure of an electronic anti-theft lock of the present invention in a closed state.

Please refer to FIG. 1 that is a plan view showing an internal structure of an electronic anti-theft lock of the present invention in a closed state. As shown, the lock mainly includes an electromagnetic valve 1 having an upward and downward movable rod 11 provided at a top thereof, such that when the electromagnetic valve 1 is actuated the rod 11 is excited to extend from the top of the electromagnetic valve 1; a locating mechanism 2 including a series of wave-like locating teeth 21 provided along a lower edge of one sidewall near an inner end thereof, an upward and downward movable restoring plate 22 provided at a bottom thereof, a turning plate 23 having a finger 24 radially projected from a peripheral edge of the plate 23 for moving the locating mechanism 2 inward or outward, a locking bolt 25 provided at an outer end of the locating mechanism 2, and a stopper 26 provided in a cavity near a lower edge of the locking bolt 25 adapted to detachably receive the rod 11 of the electromagnetic valve 1 at an extended position and thereby stop the locking bolt 25 from moving inward until the rod 11 is depressed by the restoring plate 22; and a control circuit 3 adapted to detect a correct IC code of a chip-contained key and drive the electromagnetic valve 1 to extend the rod 11 when an incorrect IC code is detected.

Figure 2:
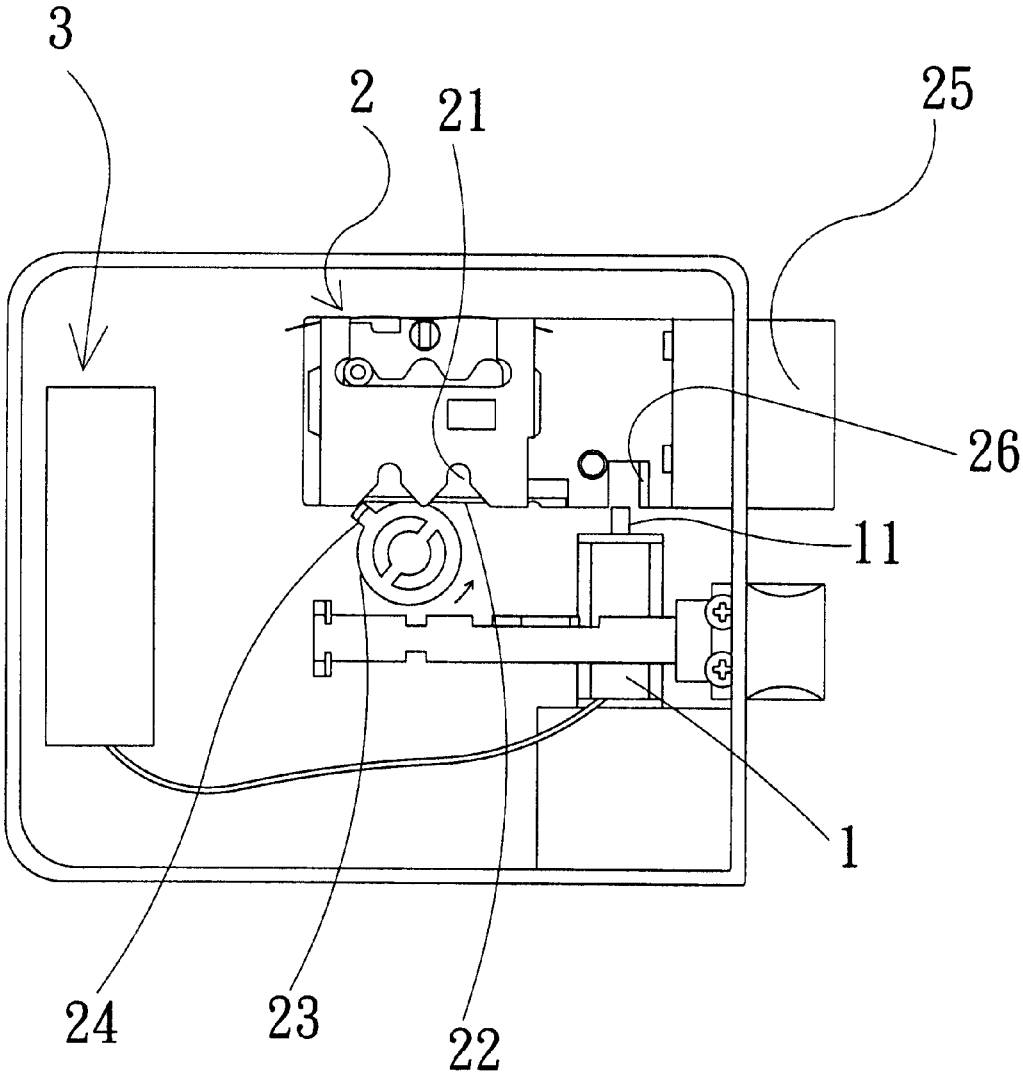
FIG. 2 shows the internal structure of the lock of FIG. 1 being opened in a first step.
Figure 3:
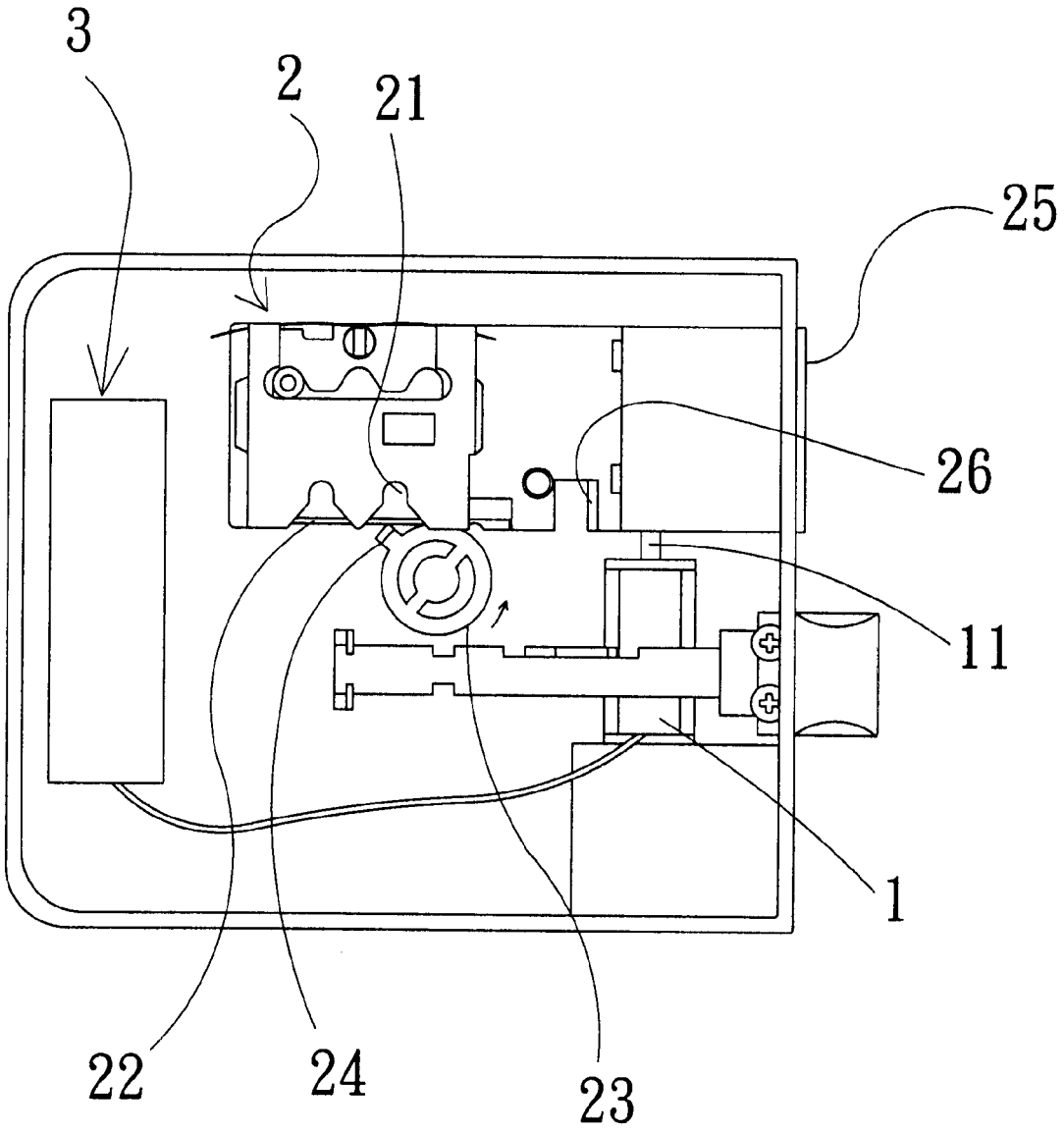
FIG. 3 shows the internal structure of the lock of FIG. 1 being opened in a second step.

When the lock of the present invention is in a closed state as shown in FIG. 1, the locking bolt 25 is projected from the lock. Meanwhile, the rod 11 of the electromagnetic valve 1 is located below the restoring plate 22, and the finger 24 of the turning plate 23 is located at an outmost side of the locating teeth 21. When a user uses a correct chip-contained key to open the lock and the control circuit 3 detects the correct IC code of the chip-contained key, the electromagnetic valve 1 is not actuated and the turning plate 23 follows a turning direction of the chip-contained key to shift the locating teeth 21 inward one by one with the finger 24, so that the whole locating mechanism 2 is moved inward step by step and the locking bolt 25 is moved into the lock, as shown in FIGS. 2 and 3. FIG. 3 shows the lock in an opened state.

Figure 4:
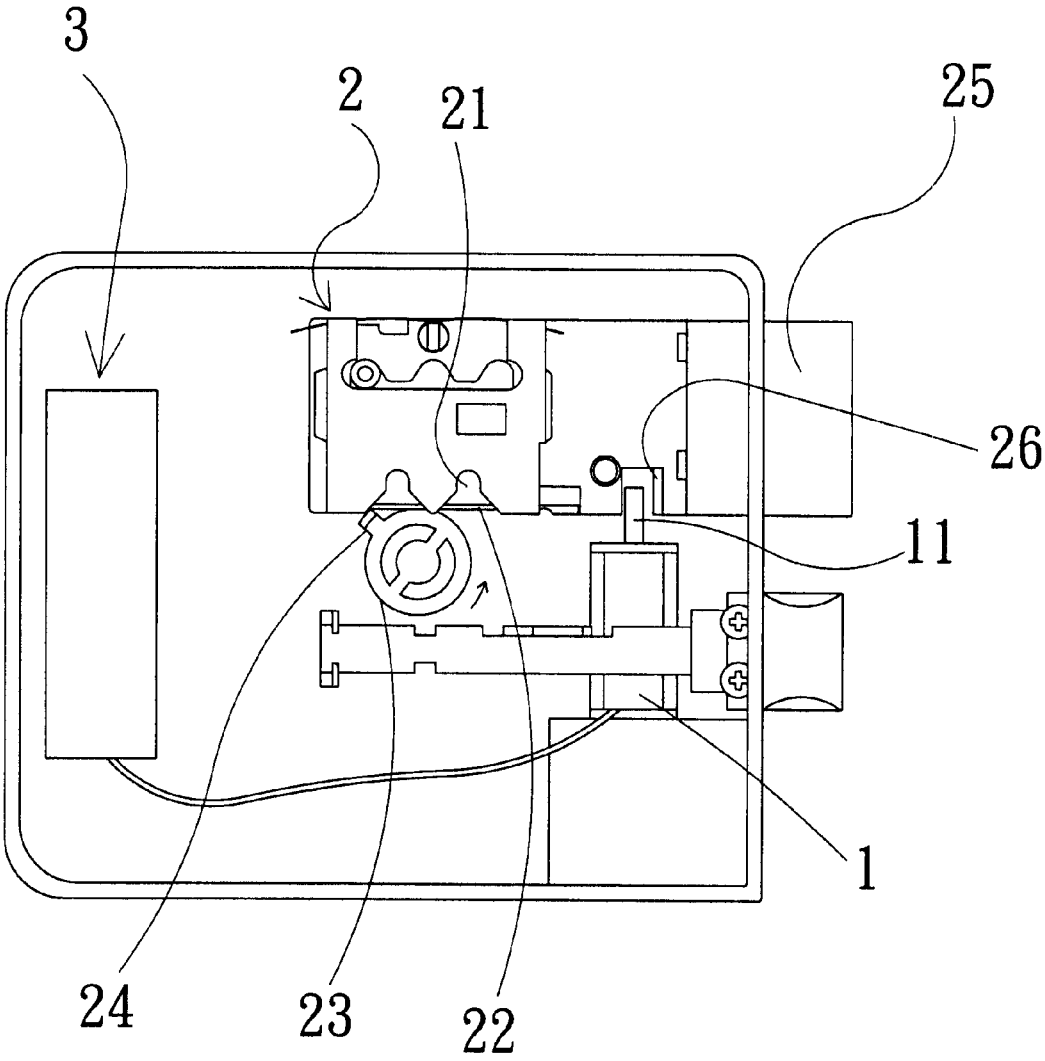
FIG. 4 shows the internal structure of the lock of FIG. 1 being closed in a first step.
Figure 5:
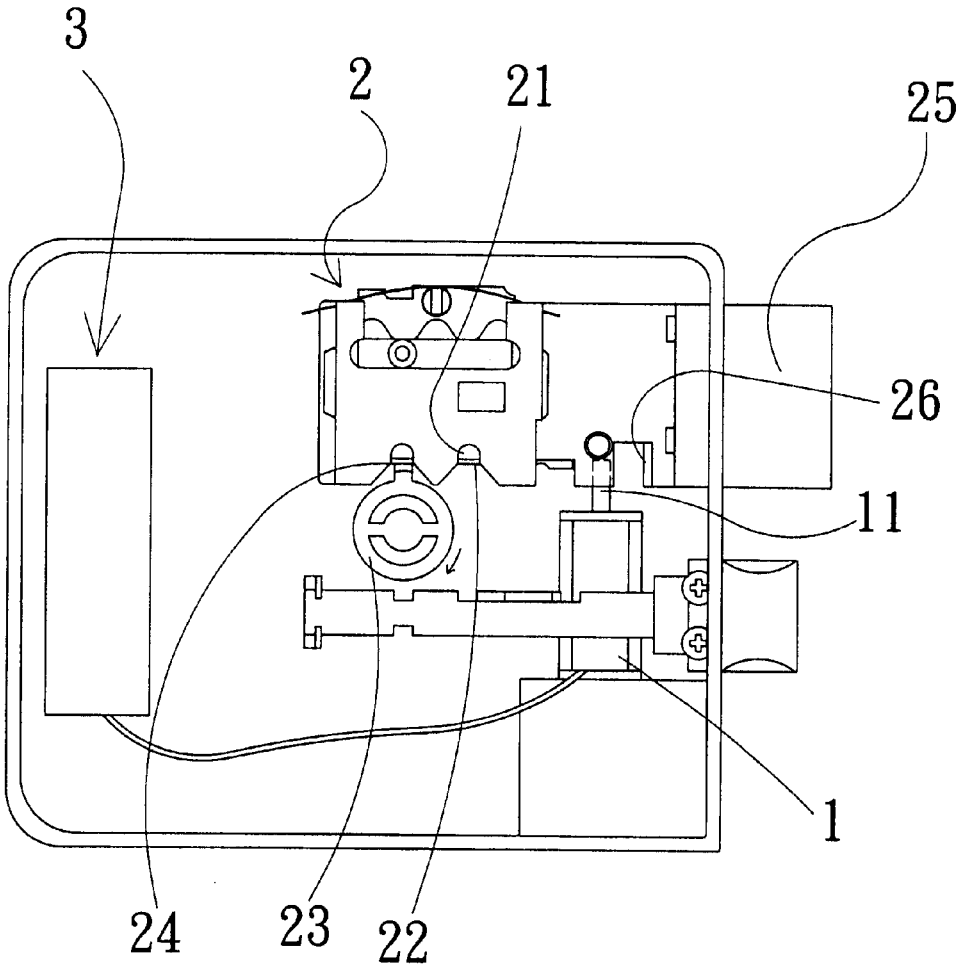
FIG. 5 shows the internal structure of the lock of FIG. 1 being closed in a second step.

Reversely, when the control circuit 3 detects an inserted chip-contained key has an incorrect IC code, it immediately actuates the electromagnetic valve 1. At this point, the turning plate 23 keeps following the turning direction of the chip-contained key to move the locating teeth 21 one by one with the finger 24 to shift the locating mechanism 2 inward step by step. With the locating mechanism 2 gradually moving inward in the lock, the restoring plate 22 provided at the bottom of the locating mechanism 2 finally moves beyond the top of the electromagnetic valve 1 to allow the rod 11 to project from the top of the electromagnetic valve 1. When the locating mechanism 2 is continuously moved inward, the stopper 26 is finally moved to a position to engage with the upward projected rod 11, stopping the locking bolt 25 from completely moving into the lock, as shown in FIG. 4. That is, the lock is now in an unlockable state. However, it is still possible to move the entire locking bolt 25 outward again to the closed position. When doing this, the turning plate 23 is turned with the key and the finger 24 thereof is moved upward to press against and push the restoring plate 22 upward while shifts the whole locating mechanism 2 outward, as shown in FIG. 5. When the turning plate 23 is kept turned, the restoring plate 22 is moved from the previously elevated position to a lowered position again to depress the projected rod 11, as shown in FIG. 1. After the locking bolt 25 is returned to the fully extended position, the user may insert the chip-contained key with correct IC code to open the lock again, as shown in FIGS. 2 and 3. In the event the control circuit 3 is out of power or failed, the electromagnetic valve 1 is not actuated to extend the rod 11, and the initially electronic lock now functions just like a regular mechanical lock and can be mechanically opened.

The control circuit 3 may be otherwise connected to an anti-theft security system (not shown), so that the latter is triggered when the electromagnetic valve 1 is actuated.

With the above arrangements, the electromagnetic valve 1 of the electronic anti-theft lock of the present invention is excited to stop the locking bolt 25 from moving inward to open the lock only when a chip-contained key with incorrect IC code is inserted. Moreover, since the mechanically movable restoring plate 22 is able to depress the rod 11 of the electromagnetic valve 1 at the upward projected position, the lock of the present invention is simple, reliable, and practical for use.

The present invention has been described with a preferred embodiment thereof and it is understood that many changes and modifications in the described embodiment can be carried out without departing from the scope and the spirit of the invention as defined by the appended claims.

What is claimed is:

1. An electronic anti-theft lock, comprising:

an electromagnetic valve having an upward and downward movable rod provided at a top thereof, such that when said electromagnetic valve is actuated said rod is excited to extend from the top of said electromagnetic valve;

a locating mechanism including a series of wave-like locating teeth provided along a lower edge of one sidewall near an inner end thereof, an upward and downward movable restoring plate provided at a bottom thereof, a turning plate located below said locating teeth and having a finger radially projected from a peripheral edge of said plate adapted to contact with said locating teeth for moving said locating mechanism inward or outward, a locking bolt provided at an outer end of said locating mechanism, and a stopper provided in a cavity near a lower edge of said locking bolt adapted to detachably receive said rod of said electromagnetic valve at an extended position and thereby stop said locking bolt from moving inward until said rod is depressed by said restoring plate; and a control circuit adapted to detect a correct IC code of an inserted chip-contained key and driving said electromagnetic valve to extend said rod when an incorrect IC code is detected;

whereby said electromagnetic valve of said electronic anti-theft lock is excited to extend said rod to stop said locking bolt from moving inward to open the lock only when a chip-contained key with incorrect IC code is inserted and detected by said control circuit, and said mechanically movable restoring plate is able to depress said upward extended rod of said electromagnetic valve again to release said locking bolt from the unlockable state into the closed state again, enabling easy, reliable, and practical use of said electronic anti-theft lock.

2. The electronic anti-theft lock as claimed in claim 1, wherein said control circuit is connected to an anti-theft security system, which is triggered when said electromagnetic valve is actuated.

* * * * *